United States Patent [19]

Douglas

[11] Patent Number: 5,007,581

[45] Date of Patent: Apr. 16, 1991

[54] GARBAGE COLLECTION DEVICE

[76] Inventor: Ray C. Douglas, R.R. 3 Box 34, Brodhead, Wis. 53520

[21] Appl. No.: 375,735

[22] Filed: Jul. 5, 1989

[51] Int. Cl.[5] ..... B65D 91/00

[52] U.S. Cl. ..... 232/43.2; 193/34; 232/44

[58] Field of Search ..... 232/44, 43.2, 43.1; 193/33, 34; 220/1 T

[56] References Cited

U.S. PATENT DOCUMENTS

| | | | |
|---|---|---|---|
| 2,802,434 | 8/1957 | Dowse | 193/34 X |
| 3,171,447 | 3/1965 | Fowler et al. | 193/34 X |
| 3,204,740 | 9/1965 | Legault | 232/44 X |
| 3,211,367 | 10/1965 | Jessop | 232/43.2 |
| 3,554,345 | 1/1971 | Mullens | 232/43.2 X |
| 3,827,348 | 8/1974 | Hennells | 232/43.2 X |

*Primary Examiner*—Robert W. Gibson, Jr.

[57] ABSTRACT

A garbage collection device is disclosed which extends through an outside wall of a dwelling for the reception therein of recyclable garbage. The device includes a garbage receptacle which is disposed externally relative to the outside wall for the reception therein of the garbage. A cover cooperates with the receptacle for covering the receptacle. The cover defines a chute for the passage therethrough of the garbage. A conduit having a first and second end is arranged such that the first end of the conduit sealingly cooperates with the chute. The conduit extends through the outside wall of the dwelling such that when garbage is inserted into the conduit through the second end thereof, the garbage passes through the conduit and the chute into the receptacle.

13 Claims, 7 Drawing Sheets

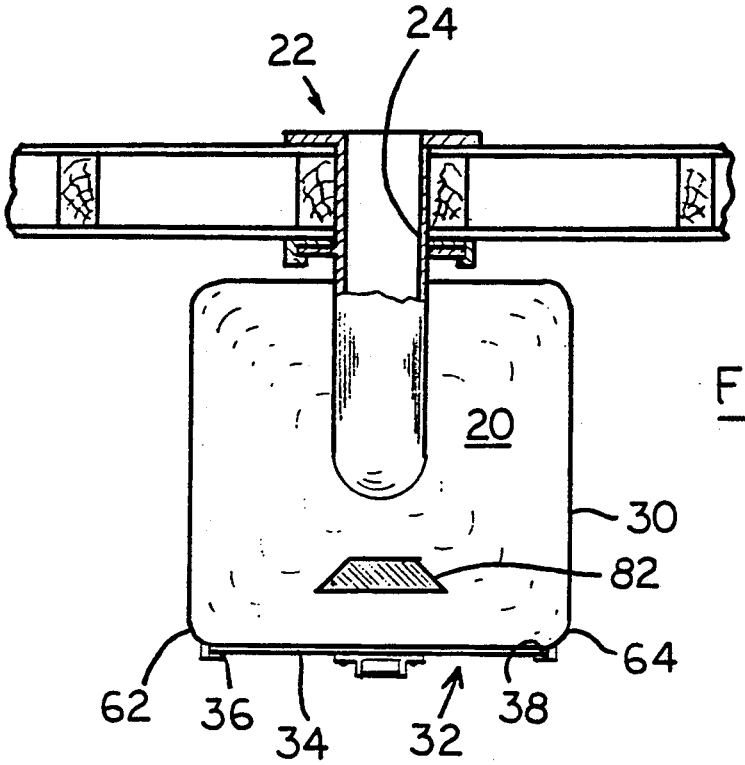
FIG. 9.
FIG. 10.
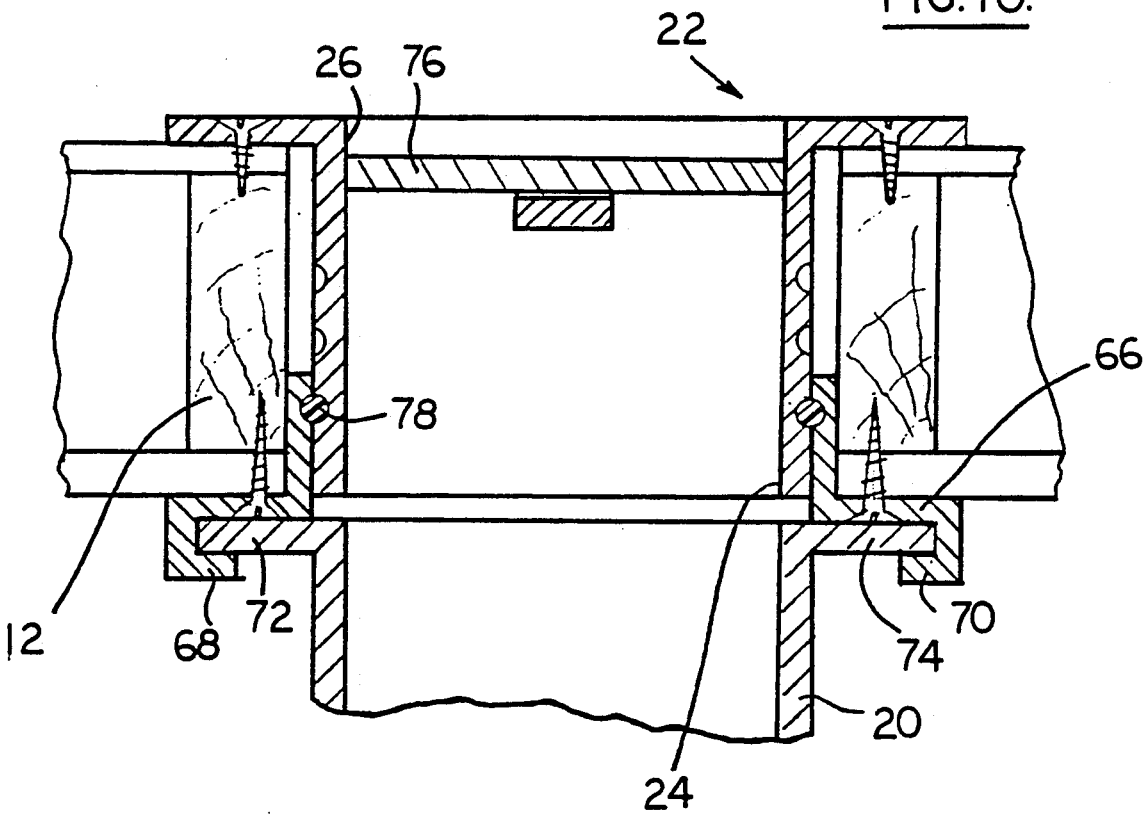

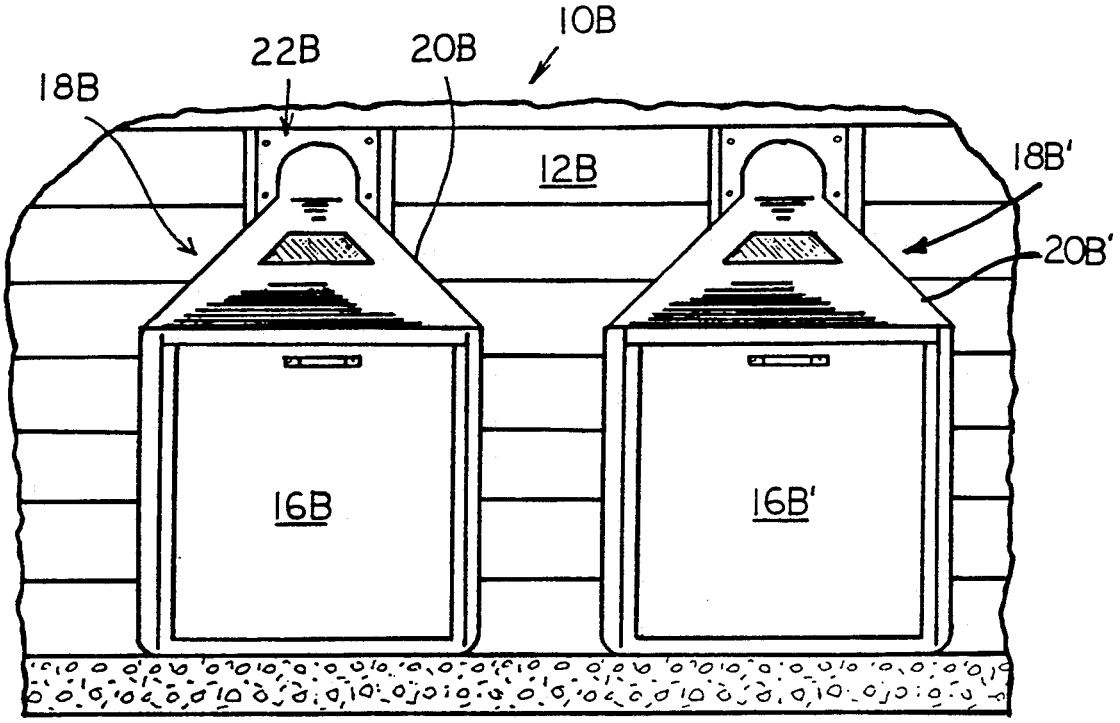
FIG. 13.
FIG. 14.
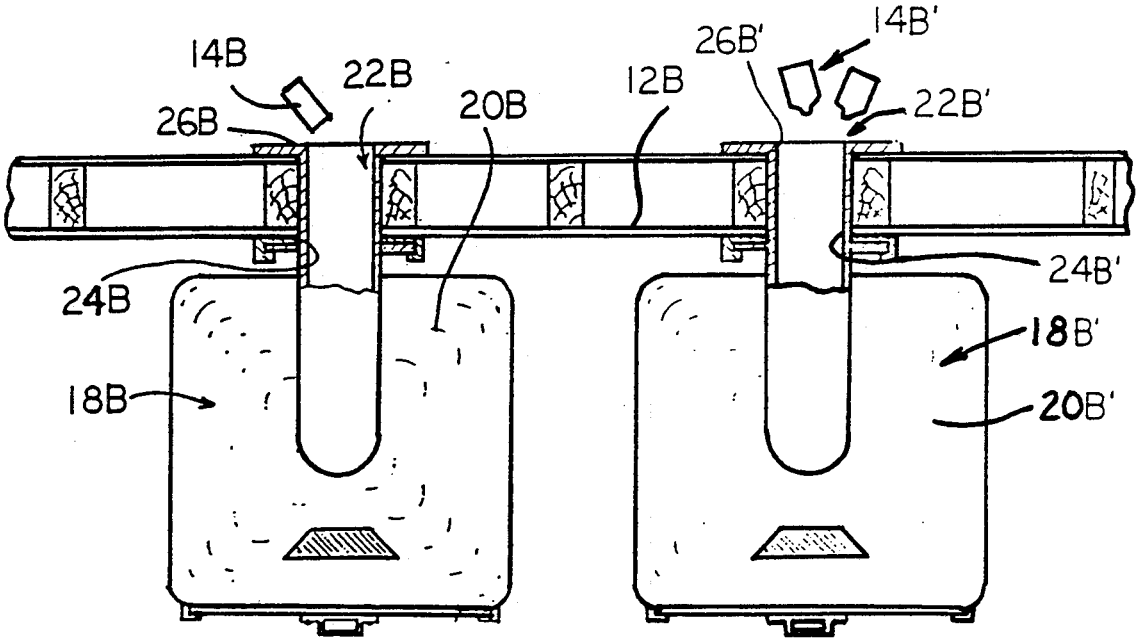

GARBAGE COLLECTION DEVICE

BACKGROUND OF THE INVENTION

1. Field of the Invention

The present invention relates to a garbage collection device which extends through an outside wall of a dwelling. More particularly, the present invention relates to a garbage collection device for the reception therein of recyclable garbage.

2. Information Disclosure Statement

The disposal of household garbage has imposed serious environmental problems. Typically, municipal garbage or household waste has been conveyed to landfill sites where such garbage has been permitted to accumulate. After filling such a site, topsoil was spread over the landfill thereby burying the garbage. However, with such landfill disposal of garbage not only is the garbage exposed to the atmosphere until covered in, thereby presenting certain health hazards but more particularly, when such landfill sites have been subsequently used as building land, subsidence and pollution hazards have been experienced.

Furthermore, with the aforementioned system for disposing of garbage many potentially useful materials have been wasted. More particularly, a large percentage of household garbage includes glass bottles which can be recycled for fabrication into various glass containers and the like. Similarly, aluminum cans and the like are able to be recycled for further use.

Much of the household garbage includes paper products which can be recycled after de-linking to produce paper and paper board products.

Although various treatment plants have been built in order to segregate household garbage into the aforementioned categories, such plants are extremely costly to construct. Additionally, such plants involve the use of relatively complex sensing and sorting equipment.

In view of the aforementioned high cost of sorting municipal waste, many authorities have imposed strict requirements and regulations regarding sorting of household garbage at source. Such regulations make the requirement that individual dwellings be provided with individual garbage receptacles and that for example glass bottles be placed in one receptacle, aluminum cans within another, while paper products be deposited within a third receptacle. Additional receptacles are also required for plastic and metal garbage.

The present invention seeks to simplify and facilitate the chore of sorting domestic garbage into the aforementioned categories without the need of leaving the dwelling in order to open the various receptacles to deposit therein the respective types of garbage.

Furthermore, the present invention provides a garbage receptacle which is completely sealed against the egress of odors and the like, and permits the storage of garbage within the respective receptacles for an extended period without any environmental pollution.

Therefore it is a primary object of the present invention to provide a garbage collection device which overcomes the aforementioned problems associated with the prior art proposals and to provide a garbage collection device which makes a considerable contribution to the art of the collection of recyclable garbage.

Another object of the present invention is the provision of a garbage receptacle which is disposed externally relative to the outside wall of a dwelling, the receptacle being closed by a cover which defines a chute for the passage therethrough of the garbage. A conduit extends through the outside wall of the dwelling such that when the garbage is inserted into the conduit through the second end thereof the garbage passes through the conduit and the chute which is connected to the first end of the conduit so that the garbage passes into the receptacle.

Another object of the present invention is the provision of a garbage collection device which includes a receptacle having a mouth. The mouth sealingly cooperating with the cover such that the garbage passes through the chute and is guided through the mouth into the receptacle.

Another object of the present invention is the provision of a garbage collection device in which the receptacle includes a housing which is formed integrally with the cover. The housing defines an unloading opening and a door sealingly cooperates with the opening for permitting selective access to the receptacle for unloading thereof.

Another object of the present invention is the provision of a garbage collection device in which the housing includes a first and second channel member for the slidable reception therein of a door so that when the door is closed the first and second edges of the door sealingly engage the housing and when the door is guided by the channels from the closed to the unloading disposition thereof, access to the receptacle is permitted.

Another object of the present invention is the provision of a garbage collection device in which a receptacle also includes a first and second rail rigidly secured to the housing and a hoop slidably supported by the rails such that when the door is closed, the hoop supported by the rails is disposed within the housing. And when the door is opened the hoop is permitted to slide on the rails outwardly through the opening.

Another object of the present invention is the provision of a garbage collection device in which a hoop disposed within the housing defines a peripheral groove. An expandable band cooperates with the groove such that a flexible replacable bag extending through the hoop is folded over the groove. The band clamps the bag against the hoop. The arrangement is such that in use of the device, garbage passes through the chute and through the hoop into the bag. When the receptacle is unloaded, the door is opened and the hoop is moved outwardly through the opening for permitting removal of the garbage contained within the bag.

Another object of the present invention is the provision of a hand grip for assisting movement of the hoop outwardly through the opening.

Another object of the present invention is the provision of a garbage collection device in which the bag has a capacity which is greater than the capacity of the receptacle. The arrangement is such that in the event of the receptacle becoming overfilled with garbage and garbage being stacked up within the chute, when the door is opened, the bag expands through the opening so that the excess capacity of the bag accomodates the stacked up garbage thereby inhibiting spilling of the garbage outside of the bag.

Another object of the present invention is the provision of a garbage collection device in which the housing is champhered in the vicinity of the unloading door such that the replacable bag is permitted to slide unimpeded through the opening.

Another object of the present invention is the provision of a garbage collection device in which a cover means is hingedly secured to the receptacle such that when the cover is in a closed disposition, the cover sealingly cooperates with the receptacle and when the cover is opened and pivoted away from the receptacle, access to the receptacle and garbage therein is permitted.

Another object of the present invention is the provision of a garbage collection device in which the cover defines a screened vent so that the garbage within the receptacle is permitted to breath while access to the garbage by insects is inhibited.

Another object of the present invention is the provision of a garbage collection device in which the cover also includes a plate which is rigidly secured to the outside wall and externally thereof, with the plate defining a first and second locking rib. The chute defines a first and second wedge member with the wedge members cooperating and engaging the locking ribs such that the chute is removable secured to the outside wall.

Another object of the present invention is the provision of a garbage collection device in which the conduit includes a closure disposed within the second end of the conduit for permitting the passage therethrough of the garbage but preventing the back flow of odors from the garbage within the receptacle back through the conduit into the dwelling.

Another object of the present invention is the provision of a garbage collection device in which the conduit sealingly cooperates with the plate such that the conduit sealingly cooperates with the chute.

Another object of the present invention is the provision of a plurality of receptacles, covers and conduits each extending through the external wall of a dwelling such that household garbage can be sorted inside the dwelling and placed within a respective conduit from within the dwelling so that the garbage is sorted into separate receptacles for subsequent collection thereof.

Other objects and advantages of the present invention will be readily apparent to those skilled in the art by a consideration of the detailed description contained hereinafter taken in conjunction with the annexed drawings.

SUMMARY OF THE INVENTION

The present invention relates to a garbage collection device for collecting garbage. The device extends through an outside wall of a dwelling for the reception therein of recyclable garbage. The device includes a garbage receptacle which is disposed externally relative to the outside wall of the dwelling for the reception therein of recyclable garbage. A cover cooperates with the receptacle for covering the receptacle. The cover defines a chute for the passage therethrough of the garbage. A conduit having a first and a second end cooperates with the chute, with the first end of the conduit sealingly cooperating with the chute. The conduit extends through the outside wall of the dwelling such that when garbage is inserted into the conduit through the second end thereof, the garbage passes through the conduit and the chute into the receptacle.

In a more specific embodiment of the present invention the receptacle also includes a housing. The housing is formed integrally with the cover means; the housing defining an unloading opening. A door having a first and a second side and a first and second edge sealingly cooperates with the opening for permitting access to the receptacle for unloading thereof.

The housing also includes a first and second channel member. The channel members are disposed parallel and spaced relative to each other adjacent to the first and second sides of the door for slidably receiving of the door therein. The arrangement is such that, when the door is disposed in a closed disposition thereof, the first and second edges of the door sealingly engage the housing. When the door is guided by the channels from the closed disposition to an unloading disposition thereof, access to the receptacle is permitted.

The receptacle also includes a first and a second rail which are rigidly secured to the housing. The rails are disposed parallel and spaced relative to each other and normal to the opening.

A hoop is slidably supported by the rails, such that when the door sealingly cooperates with the opening, the hoop supported by the rails is disposed within the housing. When the door is moved to permit access to the receptacle, the hoop is permitted to slide on the rails so that the hoop moves outwardly through the opening.

The hoop defines a peripheral groove and an expandable band cooperates with the groove. The arrangement is such that a flexible replacable bag extends through the hoop and is folded over the groove. The band clamps the bag against the hoop. The arrangement is such that in use of the device, garbage passes through the chute and through the hoop into the bag and when the receptacle is to be unloaded, the door is opened and the hoop is moved outwardly through the opening for permitting removal of the garbage contained within the bag.

The hoop also defines a hand grip for assisting movement of the hoop outwardly through the opening.

The bag has a capacity which is greater than the capacity of the receptacle such that in the event of the receptacle becoming overfilled and the garbage becoming stacked up within the chute, when the door is opened, the bag expands through the opening so that the excess capacity of the bag accomodates the stacked up garbage thereby inhibiting spilling of the garbage outside the bag.

The housing is chamfered in the vicinity of the first and second sides of the door so that the bag is permitted to slide unimpeded through the opening.

In an alternative embodiment of the present invention, the cover means is hingedly secured to the receptacle such that when the cover means is in a closed disposition thereof, the cover means sealingly cooperates with the receptacle and when the cover means is in an open disposition thereof, the cover means is pivoted relative to the receptacle for permitting access to the receptacle.

In both embodiments of the present invention the cover means defines a screened vent such that garbage within the receptacle is permitted to breath while access to the garbage by insects or the like is inhibited.

Similarly, in both embodiments of the present invention the chute sealingly and removably cooperates with the first end of the conduit means.

More specifically, the first end of the conduit means also includes a plate which is rigidly secured to the outside wall and externally thereof. The plate defines a first and second locking rib. The chute defines a first and second wedge member with the wedge members cooperating with and engaging the locking ribs so that the chute is removably connected to the outside wall.

The conduit means also includes a closure which is disposed within the second end of the conduit means for permitting the passage therethrough of the garbage but preventing the flow of odors from the garbage within the receptacle back through the conduit means into the dwelling.

The first end of the conduit means also sealingly cooperates with the plate such that the conduit means sealingly cooperates with the chute.

In a further embodiment of the present invention a garbage collection device extends through an outside wall of a dwelling for the reception therein of recyclable garbage. The device includes a first and second garbage receptacle which are disposed externally relative to the outside wall for the reception therein of a first and second type of garbage respectively. A first cover means cooperates with the first receptacle for covering the first receptacle. The first cover means defines a first chute for the passage therethrough of the first type of garbage. A first conduit means includes a first and second end, with the first end sealingly cooperating with the first chute. The first conduit means extends through the outside wall of the dwelling such that when the first type of garbage is inserted into the first conduit means through the second end thereof, the first type of garbage passes through the first conduit means and the first chute into the first receptacle. The second garbage receptacle is disposed externally relative to the outside wall for the reception therein of the second type of garbage. A second cover means cooperates with the second receptacle for covering the second receptacle. The second cover means defines a second chute for the passage therethrough of the second type of garbage. Also, a second conduit means includes a first and second extremity. The first extremity sealingly cooperates with the second chute, the second conduit extending through the outside wall of the dwelling such that when the second type of garbage is inserted into the second conduit means through the second extremity thereof, the second type of garbage passes through the second conduit means and the second chute into the second receptacle. The arrangement is such that the recyclable garbage is sorted inside the dwelling and is disposed of through the respective conduit means so that the different types of garbage are collected in respective receptacles outside the dwelling for subsequent collection thereof.

Many modifications and variations of the present invention will be readily apparent to those skilled in the art by a consideration of the detailed description of the preferred embodiment contained hereinafter taken in conjunction with the annexed drawings. However, such detailed description is merely exemplary of particular embodiments of the present invention and the invention is not limited thereto. Rather, the present invention is defined by the appended claims and such modifications and variations do not depart from this spirit and scope of the invention as defined by these appended claims.

BRIEF DECRIPTION OF THE DRAWINGS

FIG. 9 is a top plan view of the collection device shown in FIG. 1;

FIG. 10 is an enlarged sectional view of the conduit means connected to the plate;

FIG. 13 is a front view of a further embodiment of the present invention showing a plurality of receptacles for receiving different types of garbage; and FIG. 14 is a top plan view of the further embodiment shown in FIG. 13.

Similar reference characters refer to similar parts throughout the various embodiments of the present invention.

DETAILED DESCRIPTION OF THE DRAWINGS

Figure 1:
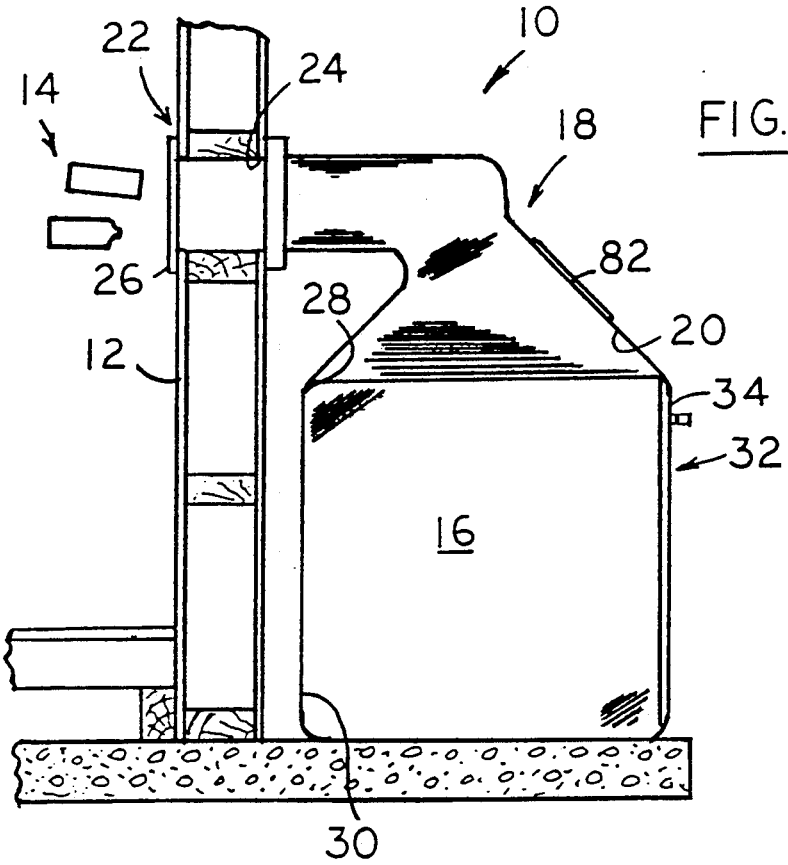
FIG. 1 is a side elevational view of one embodiment of the present invention showing a garbage collection device including a receptacle, a cover, and a conduit extending through an external wall shown in section.

FIG. 1 is a side elevational view of a garbage collection device generally designated 10 according to the present invention. The collection device 10 extends through an outside wall 12 of a dwelling for the reception therein of recyclable garbage generally designated 14. The device 10 includes a garbage receptacle 16 disposed externally relative to the outside wall 12 for the reception therein of the garbage 14.

Cover means generally designated 18 cooperates with the receptacle 16 for covering the receptacle 16. The cover means 18 defines a chute 20 for the passage therethrough of the garbage 14.

A conduit means generally designated 22 has a first and a second end 24 and 26 respectively. The first end 24 sealingly cooperates with the chute 20. The conduit means 22 extends through the outside wall 12 of the dwelling such that when the garbage 14 is inserted into the conduit means 22 through the second end 26 thereof, the garbage 14 passes through the conduit means 22 and the chute 20 into the receptacle 16.

As shown in FIG. 1, the receptacle 16 defines a mouth 28. The mouth 28 sealingly cooperates with the cover means 18 such that the garbage passes through the chute 20 and is guided through the mouth 28 into the receptacle 16.

The receptacle 16 also includes a housing 30. The housing 30 is formed integrally with the cover means 18. The housing 30 defines an unloading opening generally designated 32.

Figure 2:
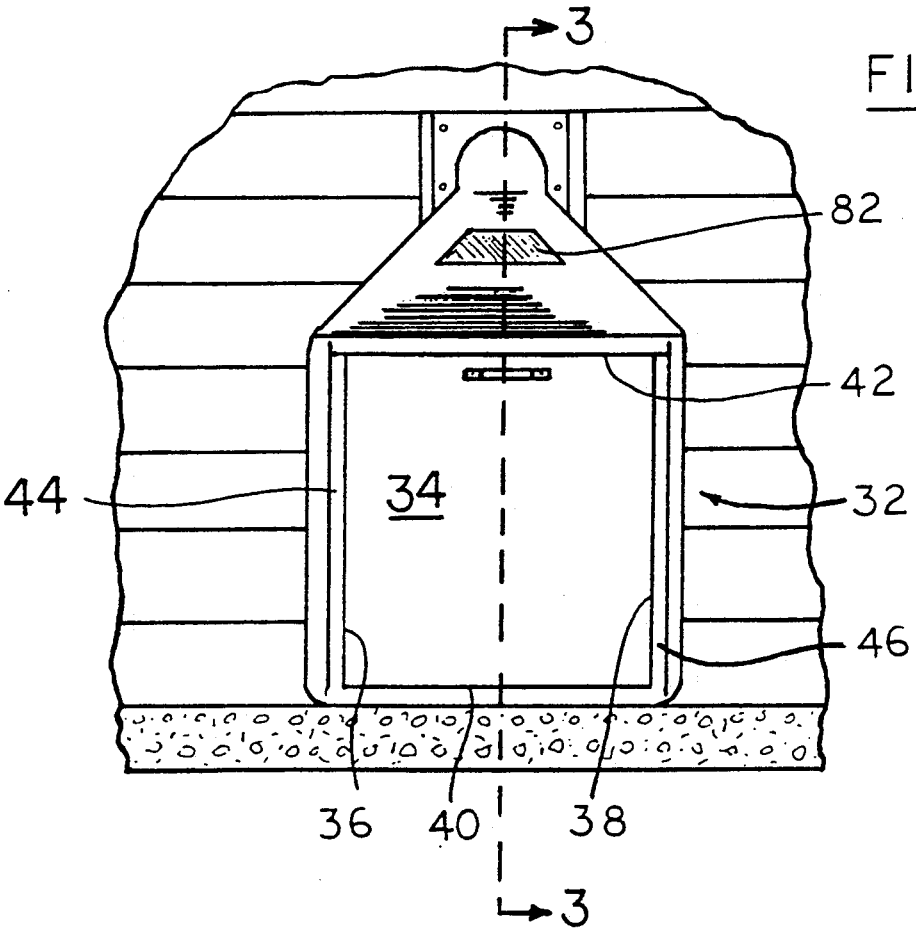
FIG. 2 is a front view of the collection device shown in FIG. 1 with the door closed.

The opening 32 is selectively closed by a door 34. The door 34 as shown in FIG. 2 includes a first and a second side 36 and 38 respectively and a first and a second edge 40 and 42 respectively. The door 34 sealingly cooperates with the opening 32 for permitting selective access to the receptacle 16 for unloading thereof.

As shown in FIGS. 1 and 2, the housing 30 also includes a first and second channel member 44 and 46 respectively. The channel members 44 and 46 are disposed paralles and spaced relative to each other adjacent to the first and second sides 36 and 38 respectively of the door 34 for slidably receiving therein the first and second sides 36 and 38 of the door 34. The arrangement is such that, when the door 34 is disposed in a closed disposition thereof as shown in FIG. 2, the first and second edges 40 and 42 of the door 34 sealingly engage the housing 30.

Figure 3:
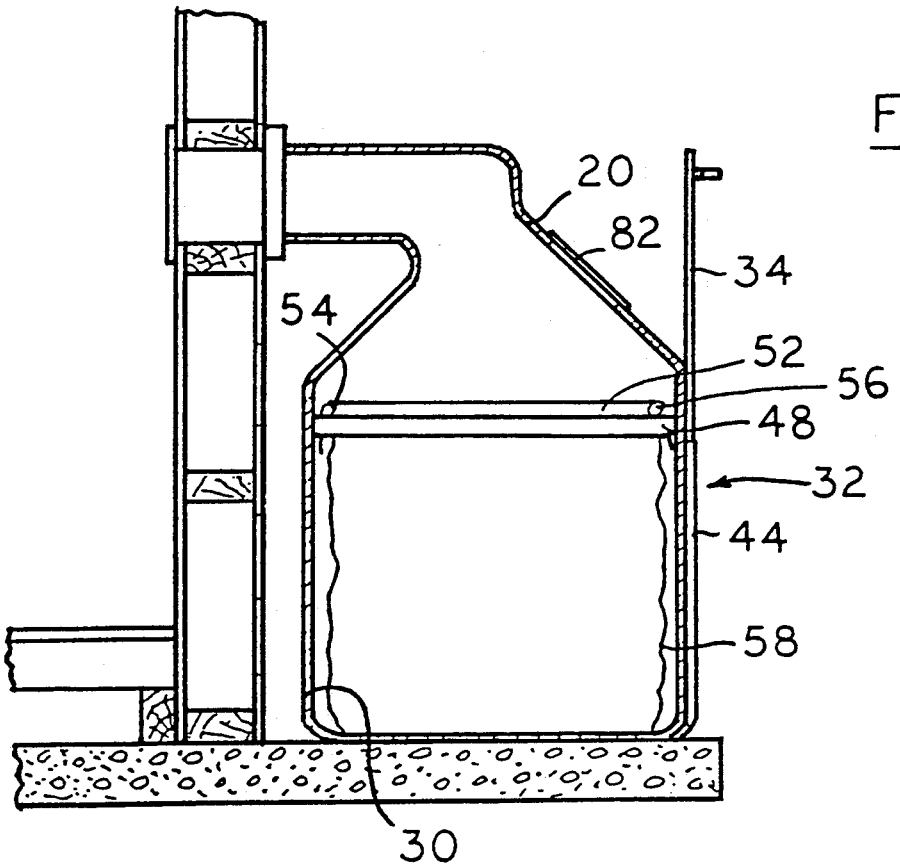
FIG. 3 is a sectional view taken on the line 3—3 of FIG. 2 but with the door open.
Figure 4:
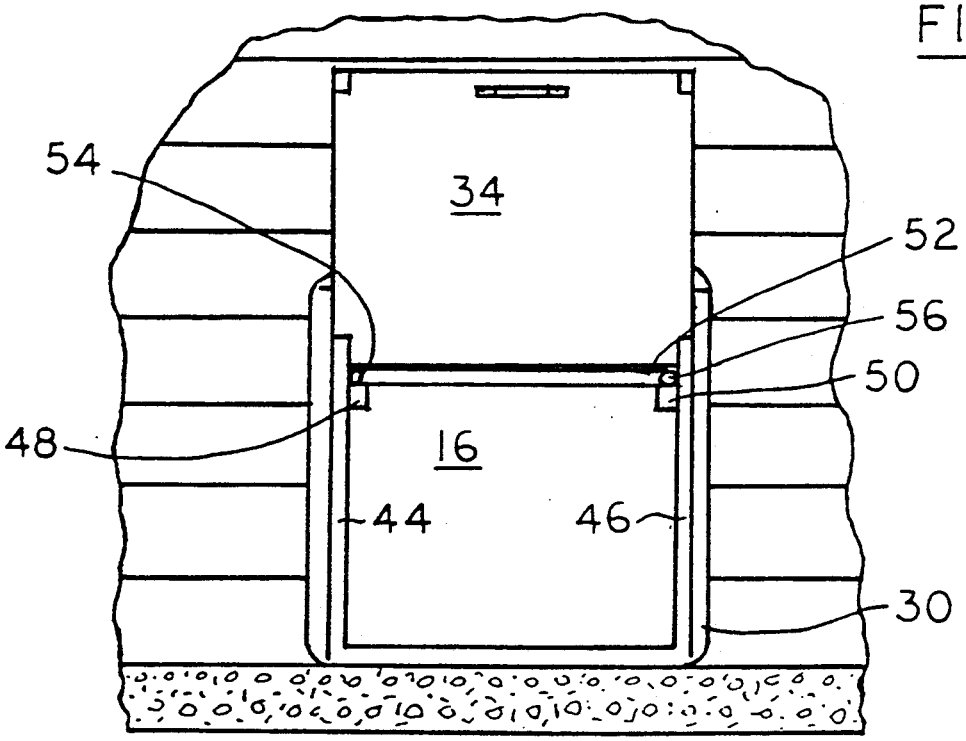
FIG. 4 is a similar view to that shown in FIG. 2 but with the door open.

The door 34 is guided by the channel members 44 and 46 respectively from the closed disposition as shown in FIG. 2 to an unloading disposition as shown in FIGS. 3 and 4 for permitting access to the receptacle 16.

The receptacle 16 as shown in FIGS. 3 and 4 also includes a first and second rail 48 and 50 which are rigidly secured to the housing 30. The rails 48 and 50 are disposed parallel and spaced relative to each other and normal to the opening 32.

A hoop 52 as shown in FIGS. 3 and 4 is slidably supported by the rails 48 and 50. The arrangement is such that when the door 34 sealingly cooperates with the opening 32, the hoop 52 supported by rails 48 and 50 is disposed within the housing 30. When the door 34 is moved as shown in FIG. 4 to permit access to the receptacle 16, the hoop 52 is permitted to slide on the rails 48 and 50 so that the hoop 52 moves outwardly through the opening 32, as described hereinafter.

The hoop defines a peripheral groove 54 and an expandable band 56 cooperates with the groove 54 such that a flexible replacable bag 58 shown in FIG. 3 extending through the hoop 52 is folded over the groove 54 and the band 56 clamps the bag 58 against the hoop 52. The arrangement is such that in use of the device 10, garbage 14 passes through the chute 20 and through the hoop 52 into the bag 58. When the receptacle 16 is to be unloaded, the door 34 is opened as shown in FIGS. 3 and 4 and the hoop 52 is moved outwardly through the opening 32 for permitting removal of the garbage 14 contained within the bag 58.

Figure 5:
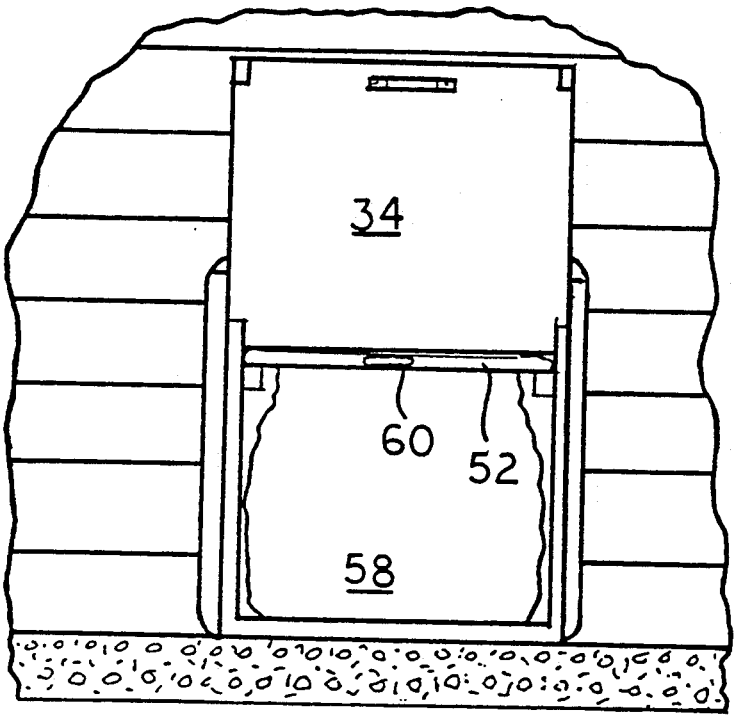
FIG. 5 is a similar view to that shown in FIG. 4 but with a bag installed within the receptacle.

In a preferred embodiment of the present invention, the hoop 52 defines a hand grip 60 shown in FIG. 5 for assisting movement of the hoop 52 outwardly through the opening 32.

Figure 6:
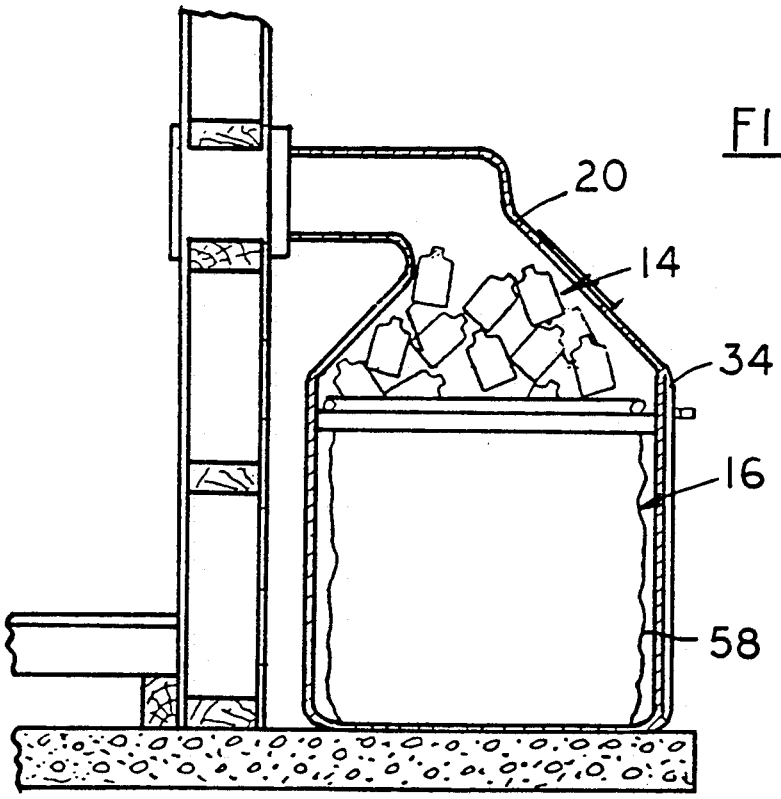
FIG. 6 is a view similar to that shown in FIG. 3 but with garbage stacked up within the cover.
Figure 7:
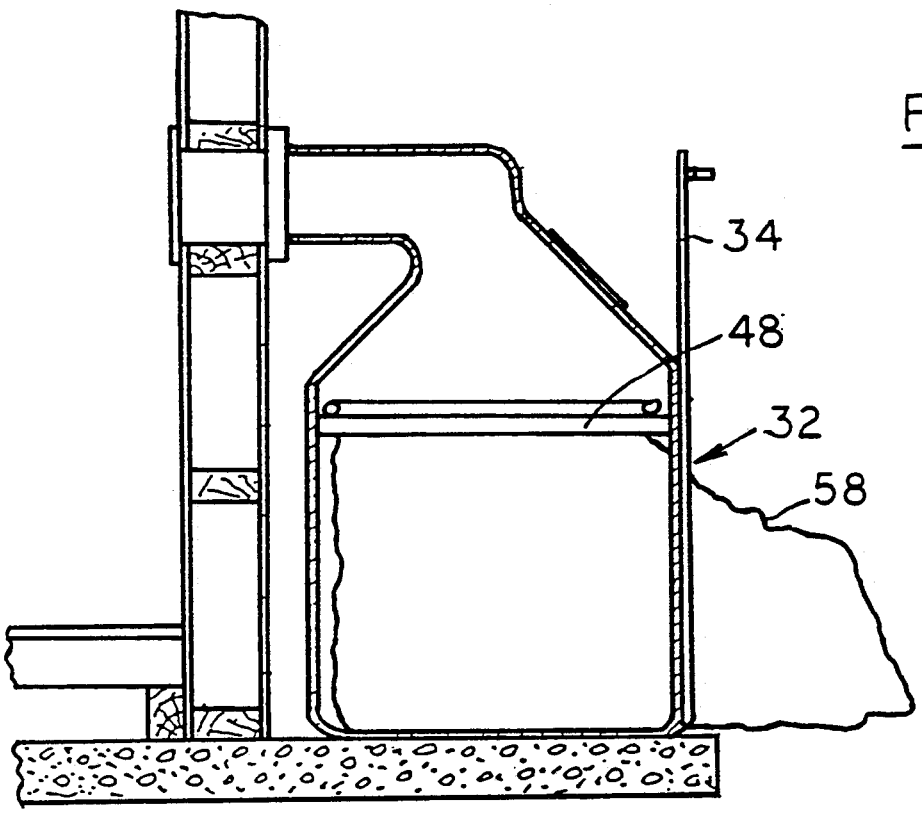
FIG. 7 is a view similar to that shown in FIG. 6 but with the door opened to accomodate the excess garbage contained within the bag.
Figure 8:
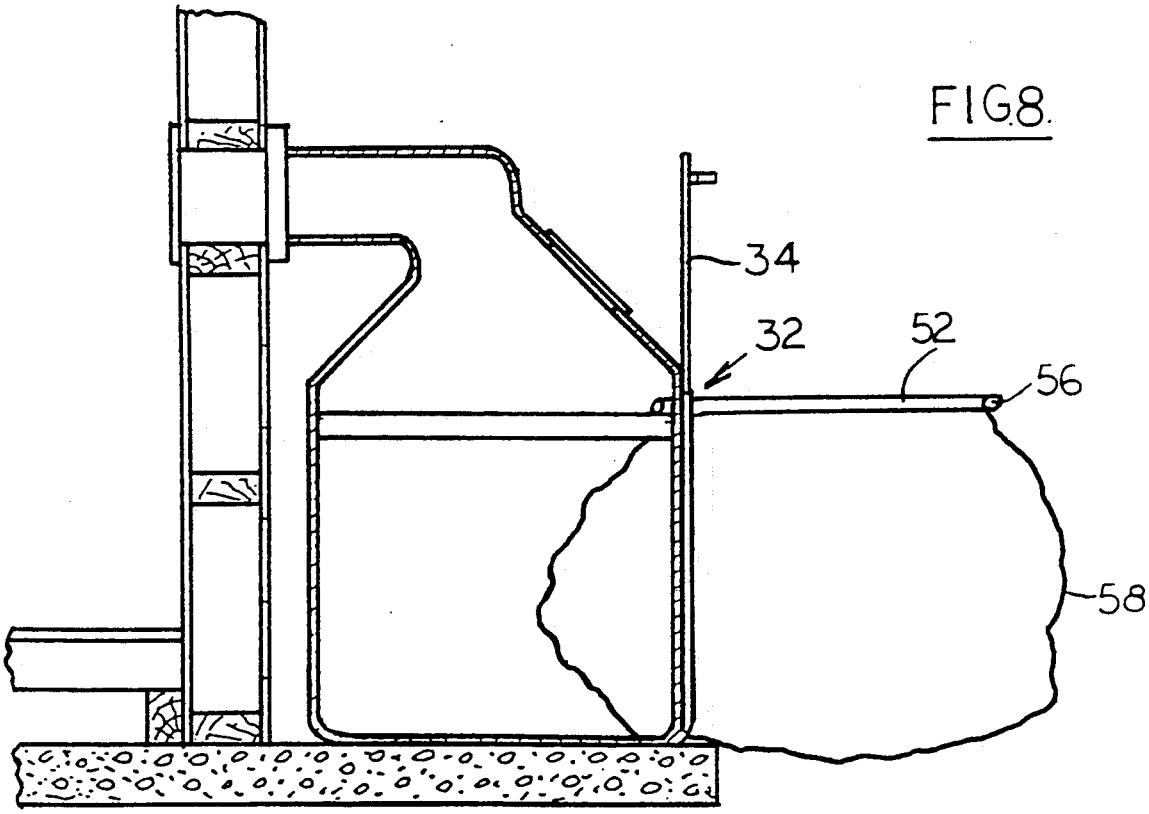
FIG. 8 is a view similar to that shown in FIG. 7 but with the hoop moved outwardly through the opening.

As shown in FIGS. 6 through 8, the bag 58 has a capacity which is greater than the capacity of the receptacle 16. The arrangement is such that in the event that the receptacle 16 becomes overfilled and garbage 14 becomes stacked up within the chute 20 as indicated in FIG. 6, when the door 34 is opened, as shown in FIG. 7, the bag 58 expands through the opening 32 so that the excess capacity of the bag 58 accommodates the stacked up garbage 14 thereby inhibiting spilling of the garbage 14 outside the bag 58. FIG. 8 shows the excess garbage contained within the bag 58 and the hoop 52 having been moved outwardly through the opening 32.

As shown in FIG. 9, the housing 30 is chamfered at 62 and 64 in the vicinity of the first and second sides 36 and 38 respectively of the door 34 such that the bag 58 is permitted to slide unimpeded through the opening 32.

As shown in FIGS. 1 through 9, the chute 20 sealingly and removably cooperates with the first end 24 of the conduit means 22.

In one embodiment of the present invention as shown in FIG. 10, the conduit means 22 also includes a plate 66 rigidly secured to the outside wall 12 and externally thereof. The plate 66 defines a pair of locking ribs 68 and 70 respectively. The chute 20 defines a first and second wedge member 72 and 74 respectively. The first and second wedge members 72 and 74 cooperate with and engage said pair of locking ribs 68 and 70 such that the chute 20 is removably secured to the outside wall 12. Such removal is achieved by upward movement of the chute 20 relative to the ribs 68 and 70.

As shown in FIG. 10, the conduit means 22 also includes a closure means or flap valve 76 which is disposed within the second end 26 of the conduit means 22 for permitting the passage therethrough of the garbage 14. The flap valve 76 may be of an insulating material. Such flap valve 76 prevents the flow of odors from the receptacle 16 back through the conduit means 22 into the dwelling.

As shown in FIG. 10 the first end 24 of the conduit means 22 sealingly cooperates with the plate 66 by means of a circumfential O ring 78 such that the conduit means 22 sealingly cooperates with the chute 20.

Figure 11:
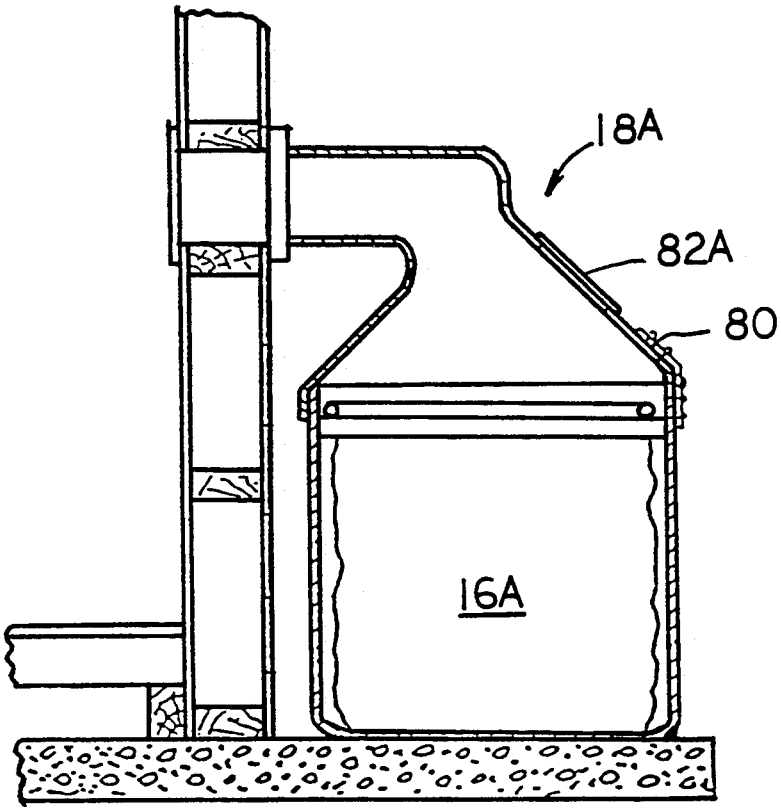
FIG. 11 is a sectional view of an alternative embodiment of the present invention showing the cover hinged to the receptacle.
Figure 12:
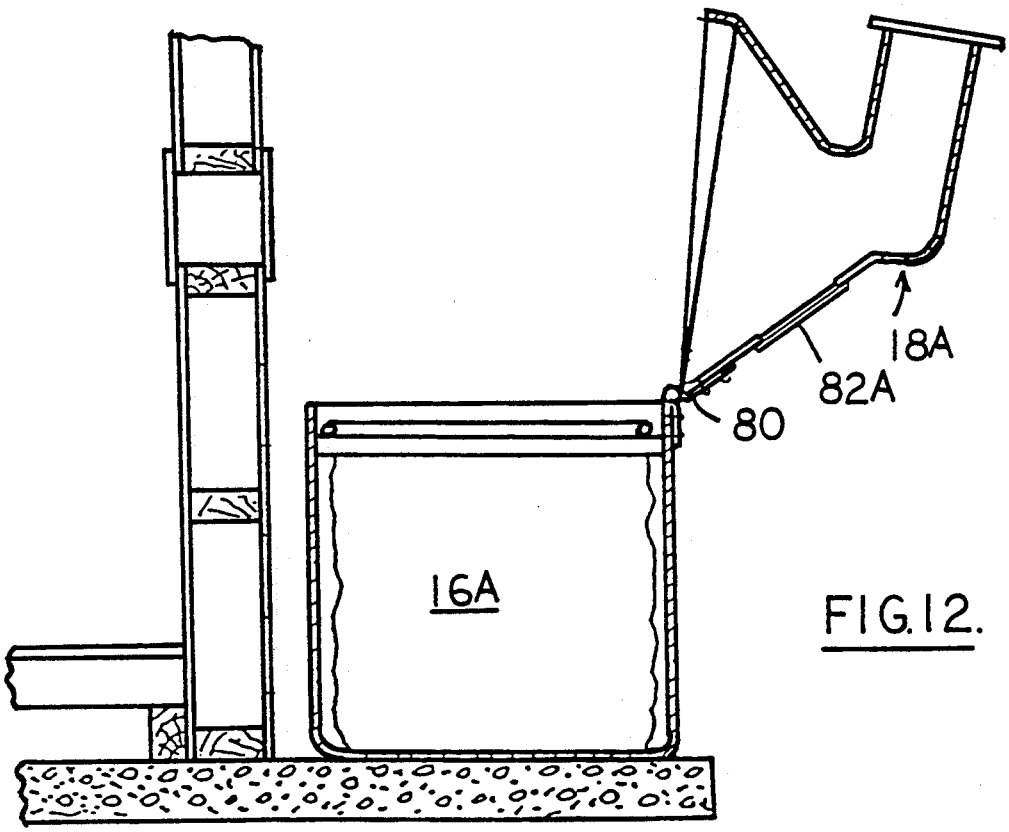
FIG. 12 is a similar view to that shown in FIG. 11 but shows the cover hinged to an open disposition thereof.

In an alternative embodiment of the present invention as shown in FIG. 11 the cover means 18A is hingedly secured by a hinge 80 to the receptacle 16A such that when the cover means 18A is in a closed disposition thereof as shown in FIG. 11, the cover means 18A sealingly cooperates with the receptacle 16A. However, when the cover means 18A is in an open disposition thereof as shown in FIG. 12, the cover means 18A is pivoted about the hinge 80 relative to the receptacle 16A for permitting access to the receptacle 16A.

In both embodiments shown in FIGS. 1 to 10 and 11 to 12, the cover means 18 and 18A define a screened vent 82 and 82A respectively such that garbage within the receptacle 16 and 16A is permitted to breath while access to the garbage by insects or the like is inhibited. Vents 82 and 82A may be louvered or otherwise suitably weatherproofed.

In a further embodiment of the present invention, as shown in FIG. 13 and 14 a garbage collection device 10B extends through an outside wall 12B of a dwelling for the reception therein of recyclable garbage. The device 10B includes a first garbage receptacle 16B disposed externally relative to the outside wall 12B for the reception therein of a first type of garbage 14B shown in FIG. 14 such as aluminum cans.

A first cover means 18B cooperates with the first receptacle 16B for covering the first receptacle 16B. The first cover means 18B defines a first chute 20B for the passage therethrough of the first type of garbage 14B.

A first conduit means 22B having a first and a second end 24B and 26B respectively, with the first end 24B cooperating with the first chute 20B. The first conduit means 22B extends through the outside wall 12B of the dwelling such that when the first type of garbage 14B is inserted into the conduit means 22B through the second end 26B thereof, the first type of garbage 14B passes through the first conduit means 22B and the first chute 20B into the receptacle 16B.

A second garbage receptacle 16B1 is disposed externally relative to the outside wall 12B and adjacent to the first receptacle 16B for the reception therein of a second type of garbage such as bottles 14B1 shown in FIG. 14.

A second cover means 18B1 cooperates with the second receptacle 16B1 for covering the second receptacle. The second cover means 18B1 defines a second chute 20B1 for the passage therethrough of the second type of garbage 14B1.

A second conduit means 22B1 includes a first and second extremity 24B1 and 26B1 respectively. The first extremity 24B1 sealingly cooperates with the second chute 20B1. The conduit means 22B1 extends through the outside wall 12B of the dwelling such that when the second type of garbage 14B1 is inserted into the second conduit means 22B1 through the second end 26B1 thereof, the second type of garbage 14B1 passes through the second conduit 22B1 and the chute 20B1 into the second receptacle 16B1.

The arrangement is such that the two types of garbage are sorted inside the dwelling prior to placing the separated garbage into the respective first and second conduit means 22B and 22B1 respectively, so that the garbage is collected in the respective garbage receptacles 16B and 16B1 for subsequent transportation to a recycling plant.

What is claimed is:

1. A garbage collection device extending through an outside wall of a dwelling for the reception therein of recyclable garbage, said device comprising:

a garbage receptacle disposed externally relative to the outside wall for the reception therein of the recyclable garbage;

cover means cooperating with said receptacle for covering said receptacle, said cover means defining a chute for the passage therethrough of the garbage;

a conduit means having a first and a second end, said first end cooperating with said chute, said conduit means extending through the outside wall of the dwelling such that when the recyclable garbage is inserted into said conduit means through said second end thereof, the recyclable garbage passes through said conduit means and said chute into said receptacle;

said receptacle including:

a housing, said housing being formed integrally with said cover means, said housing defining an unloading opening;

a door having a first and a second side and a first and a second edge, said door sealingly cooperating with said opening for permitting selective access to said receptacle for unloading thereof; and said housing further including:

a first and a second channel member, said channel members being disposed parallel and spaced relative to each other adjacent to said first and second sides of said door for slidably receiving therein said first and second sides of said door such that when said door is disposed in a closed disposition thereof, said first and second edges of said door sealingly engage said housing, said door being guided by said channels from said closed disposition to an unloading disposition for permitting access to said receptacle.

2. A garbage collection device as set forth in claim 1 wherein said receptacle defines a mouth, said mouth sealingly cooperating with said cover means such that the recyclable garbage passing through said chute is guided through said mouth into said receptacle.

3. A garbage collection device as set forth in claim 1 wherein said cover means defines a screened vent such that garbage within said receptacle is permitted to breath while access to the garbage by insects is inhibited.

4. A garbage collection device as set forth in claim 1 wherein said chute sealingly and removably cooperates with said first end of said conduit means.

5. A garbage collection device as set forth in claim 1 wherein said conduit means further includes:

a closure means disposed within said second end of said conduit means for permitting the passage therethrough of the garbage but preventing the flow of odors from the garbage within said receptacle back through said conduit means into the dwelling.

6. A garbage collection device as set forth in claim 1 wherein said conduit means sealingly engages the outside wall.

7. A garbage collection device extending through an outside wall of a dwelling for the reception therein of recyclable garbage, said device comprising:

a garbage receptacle disposed externally relative to the outside wall for the reception therein of the recyclable garbage;

cover means cooperating with said receptacle for covering said receptacle, said cover means defining a chute for the passage therethrough of the garbage;

a conduit means having a first and a second end, said first end cooperating with said chute, said conduit means extending through the outside wall of the dwelling such that when the recyclable garbage is inserted into said conduit means through said second end thereof, the recyclable garbage passes through said conduit means and said chute into said receptacle;

said receptacle including:

a housing, said housing being formed integrally with said cover means, said housing defining an unloading opening;

a door having a first and a second side and a first and a second edge, said door sealingly cooperating with said opening for permitting selective access to said receptacle for unloading thereof;

said receptacle further including:

a first and second rail rigidly secured to said housing, said rails being disposed parallel and spaced relative to each other and normal to said opening;

a hoop slidably supported by said rails such that when said door sealingly cooperates with said opening, said hoop supported by said rails is disposed within said housing and when said door is moved to permit access to said receptacle, said hoop is permitted to slide on said rails so that said hoop moves outwardly through said opening;

said hoop defining a peripheral groove; and an expandable band cooperating with said groove such that a flexible replacable bag extending through said hoop is folded over said groove and said band clamps said bag against said hoop, tha arrangement being such that in use of the device, garbage passes through said hoop into said bag and when said receptacle is to be unloaded, said door is opened and said hoop is moved outwardly through said opening for permitting removal of garbage contained within said bag.

8. A garbage collection device as set forth in claim 7 wherein said hoop defines a hand grip for assisting movement of said hoop outwardly through said opening.

9. A garbage collection device as set forth in claim 7 wherein said bag has a capacity which is greater than the capacity of said receptacle such that in the event of the receptacle becoming overfilled and the garbage becoming stacked up within said chute, when said door is opened, said bag expands through said opening so that the excess capacity of said bag accomodates said stacked up garbage thereby inhibiting spilling of the garbage outside said bag.

10. A garbage collection device as set forth in claim 7 wherein said housing is chamfered in the vicinity of said first and second sides of said door such that said bag is permitted to slide unimpeded through said opening.

11. A garbage collection device extending through an outside wall of a dwelling for the reception therein of recyclable garbage, said device comprising:

a garbage receptacle disposed externally relative to the outside wall for the reception therein of the recyclable garbage;

cover means cooperating with said receptacle for covering said receptacle, said cover means defining a chute for the passage therethrough of the garbage;

a conduit means having a first and a second end, said first end cooperating with said chute, said conduit means extending through the outside wall of the dwelling such that when the recyclable garbage is inserted into said conduit means through said second end thereof, the recyclable garbage passes through said conduit means and said chute into said receptacle; and said cover means being hingedly secured to said receptacle such that when said cover means is in a closed position thereof, said cover means sealingly cooperates with said receptacle and when said cover means is in an open disposition thereof, said cover means is pivoted relative to said receptacle for permitting access to said receptacle.

12. A garbage collection device extending through an outside wall of a dwelling for the reception therein of recyclable garbage, said device comprising:

a garbage receptacle disposed externally relative to the outside wall for the reception therein of the recyclable garbage;

cover means cooperating with said receptacle for covering said receptacle, said cover means defining a chute for the passage therethrough of the garbage;

a conduit means having a first and a second end, said first end cooperating with said chute, said conduit means extending through the outside wall of the dwelling such that when the recyclable garbage is inserted into said conduit means through said second end thereof, the recyclable garbage passes through said conduit means and said chute into said receptacle;

said chute sealingly and removably cooperating with said first end of said conduit means;

said first end of said conduit means further including:

a plate rigidly secured to said outside wall and externally thereof, said plate defining a first and second locking rib; and said chute defining a first and second wedge member, said first and second wedge members cooperating respectively with and engaging said locking ribs such that said chute is removably connected to the outside wall.

13. A garbage collection device as set forth in claim 12 wherein said first end of said conduit means sealingly cooperates with said plate such that said conduit means sealingly cooperates with said chute.

* * * * *